United States Patent [19]

Kahn

[11] 4,160,875

[45] Jul. 10, 1979

[54] SECURITY SYSTEM

[76] Inventor: Leonard R. Kahn, 70 N. Grove St., Freeport, N.Y. 11520

[21] Appl. No.: 796,123

[22] Filed: May 12, 1977

[51] Int. Cl.[2] ..... H04K 1/00

[52] U.S. Cl. ..... 179/1.5 M; 179/1 AA; 179/1.5 R

[58] Field of Search ..... 179/1.5 R, 1.5 M, 1 AA

[56] References Cited

U.S. PATENT DOCUMENTS

| | | | |
|---|---|---|---|
| 2,905,747 | 9/1959 | Kidd et al. | 179/1.5 R |
| 3,552,520 | 1/1971 | Naubereit | 340/15 |
| 3,564,493 | 2/1971 | Hicklin | 340/15 |
| 3,624,297 | 11/1971 | Chapman | 179/1.5 R |
| 3,718,765 | 2/1973 | Halaby | 179/1.5 M |
| 3,723,878 | 3/1973 | Miller | 179/1.5 R |
| 3,909,534 | 9/1975 | Majeau et al. | 179/1.5 R |

*Primary Examiner*—Howard A. Birmiel

[57] ABSTRACT

A security system for use in homes, hotels, businesses, schools, streets, and other locations requiring a high degree of security but where it is important to insure the privacy of the protected individual.

20 Claims, 2 Drawing Figures

SECURITY SYSTEM

BACKGROUND OF THE INVENTION

While the invention is subject to a wide range of application, it is especially suitable for use in a security system interconnected by telephone circuits and will be particularly described in this connection.

There are a number of methods for providing security; including, guards, closed circuit television, and sonic devices. One particularly effective system is one that uses microphones to monitor sounds in an area with security personnel listening for unusual sounds indicating a dangerous situation. For example, a conventional intercommunication system can be operated with "live" microphones so that an individual monitoring the system can detect strange sounds indicating trespass or unauthorized activities. Such an arrangement may be a most effective system as a skilled individual can quickly evaluate a situation and determine if action is required. Unfortunately, such a system presents a most serious threat to the privacy of individuals located near the live microphones and therefore such a system is unacceptable to many people.

SUMMARY OF THE INVENTION

It is an object of the present invention to provide an improved means for guarding individuals and property.

It is a further object to provide improved security while avoiding the invasion of privacy of people working or living in areas serviced by a security system.

Another object of the invention is to provide inexpensive security equipment.

it is still another object to provide a security system which can be readily switched to a mode of operation not providing privacy but improved security at the user's option.

It is a further object of the security method to allow the use of either radio or wire transmission to a central monitoring location.

This invention may also be used to provide security to individuals walking in unsafe streets, parks, etc. In that type of application, the invention would utilize a light weight radio transmitter to radiate a signal to a monitor receiver and even though a radio system is utilized the invention would allow the user to enjoy privacy in conversing with friends and associates.

The method improves the performance of security systems by performing the following steps:

(a) Converting sound waves to electrical waves.

(b) Altering the electrical waves so as to destroy or greatly reduce the intelligibility of any speech signals that happen to be present in the electrical waves.

(c) And then transmit the processed electrical wave to a monitoring location either by telephone channels or radio systems.

One of the most important aspects in successfully applying the subject invention is the efficiency of the methods used to destroy the intelligence bearing characteristics of voice signals. Such destructive encoding wants to be accomplished with minimum of loss of information of other sounds; such as the breaking of glass, etc. It would also be highly desirable if sounds of danger, which are part of the voice, are not disturbed. For example, a loud scream or shout in additon to carrying normal speech intelligence also includes high frequency sounds which carry most important information for the security of the individual. Therefore, in destroying the information borne by normal words spoken in privacy it is desirable that other vocal sounds which do not convey normal word information be subjected to as little distortion as possible. However, it is within the scope of this invention to transmit highly distorted sounds that require monitoring personnel to learn to recognize danger indicating encoded sounds.

One effective method for destructively encoding speech waves is to eliminate, or greatly attenuate, all sound components in the range, of say, approximately 300 to 3,000 Hz. Such elimination will greatly reduce the intelligibility of speech and will, for many practical purposes, satisfy the privacy requirement.

It is also possible to frequency translate components of the speech so as to seriously degrade intelligibility. Frequency translation, however, unless properly performed can be counteracted so as to provide a decoded speech wave with good intelligibility. However, frequency translation can be effectively used to destroy intelligibility, if the translation is done properly, for example, by following a random pattern with a high enough rate of frequency translation change so as to eliminate the possibility of adjusting a "clarifier" so as to restore intelligibility. A combination of band elmination and frequency translation can be used to provide further improved privacy. However, it should be stressed that the minimum amount of processing should be used to insure adequate security so that the remaining sound waves provide a maximum information content as to emergency situations so that the monitors may do a satisfactory job.

In destroying intelligibility, it is most important that all clues, as to the method of destructive encoding, be minimized so that decoding is made impractical or impossible. The fact that the encoded wave never requires decoding greatly reduces the complexity of encoding and there is no need for synchronism or other transmissions of decoding information because it is within the meaning of this invention that the voice wave never be decoded.

The monitoring equipment may use circuitry for improving the intelligibility of the emergency or distress signals and for enhancing the listenability of the sound. But the destructive encoding should be of such a nature that any efforts to decode confidential voice messages should be completely defeated by the means and methods of encoding.

Thus, unlike normal secrecy or privacy systems, the decoding of the message, in order to recover voice messages, should be impossible or highly impractical.

The above stated objects and other objects, features, characteristics, and advantages of the systems and methods of the invention, will be apparent from the following description of certain typical forms thereof taken together with the accompanying drawing.

DESCRIPTION OF THE PREFERRED EMBODIMENT

Figure 1:
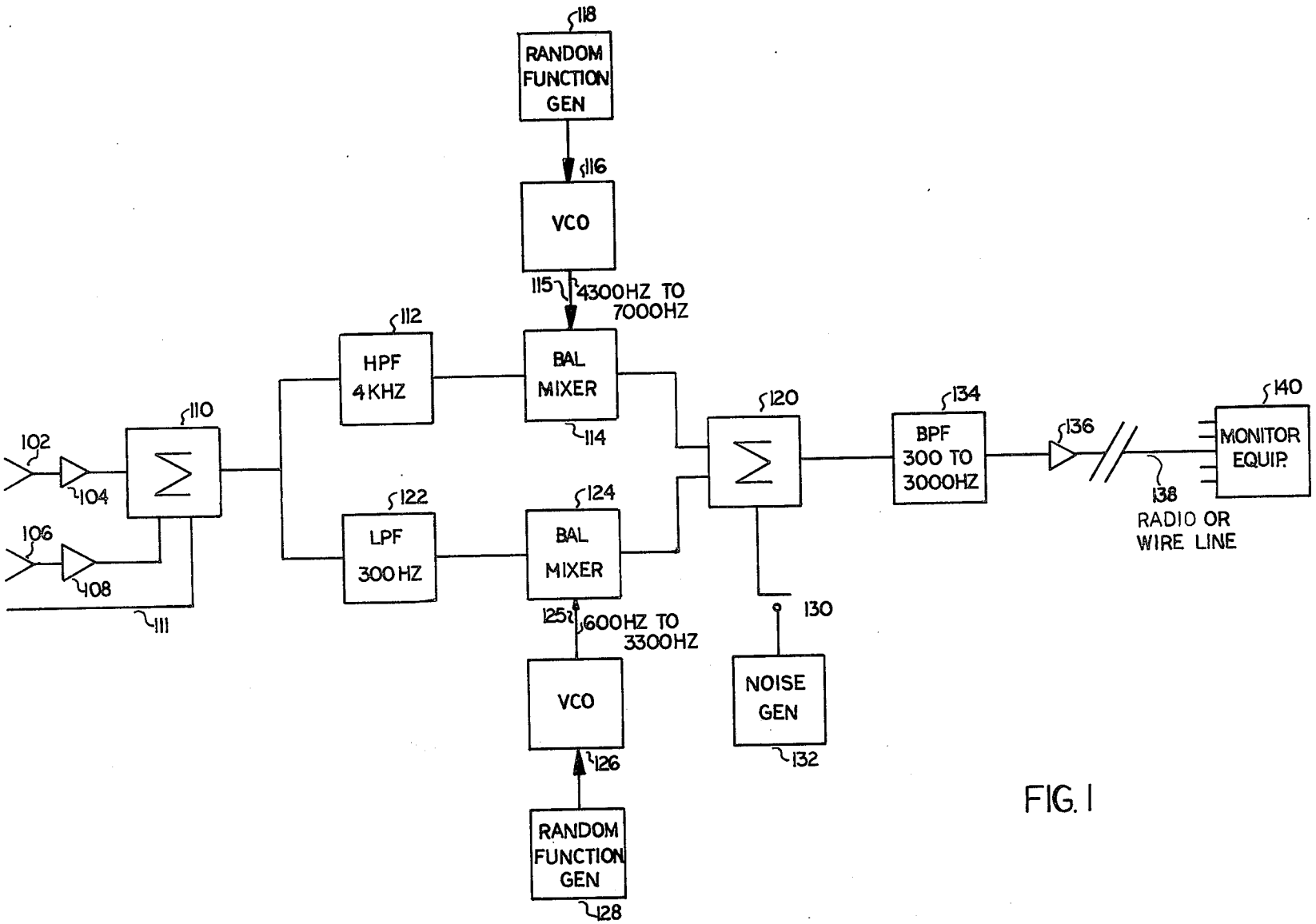
FIG. 1 is a Block Diagram, showing one embodiment of the instant invention for providing security to individuals and property.

FIG. 1 shows one of many possible embodiments of the invention in block form. A microphone, 102, which is located in an area being monitored, feeds an amplifier, 104, which in turn feeds summation circuit 110. The output of a second microphone 106 which is located so as to cover a second area, is amplified by amplifier 108, which in turn also feeds summation circuit 110. Of course, some businesses or homes may only require one microphone to provide adequate coverage while others may require many microphones which could be fed to summation circuit 110 via connection 111, or the signals from such microphones may be separately encoded. It is most important for the privacy of the individuals being protected by this system that the outputs of the microphones cannot be "tapped" or listened to prior to the special encoding described below. Therefore, the wiring to the microphones should be located so that unauthorized personnel do not have access to the wiring. If only a single microphone is required, circuit 110 is not required.

The output of summation circuit 110 feeds two filters, a highpass filter 112 and a lowpass filter 122. The highpass filter 112 passes electrical components above 4,000 Hz and greatly attenuates frequency components below approximately 3,000 or 3,500 Hz. It is important that the components below, say for example, 3,000 Hz, be sufficiently attentuated so that inverse frequency network systems cannot be used to restore the filtered out components because of noise introduced by the equipment normally used for such processing. As described below, a built-in noise generator may be incorporated in the encoding equipment to further insure the impracticability of restoring the attenuated voice components. Similarly, 300 Hz cutoff lowpass filter 122 should provide sufficient attenuation for components above, say, 400 Hz, so that it is impossible or impractical to counteract the effects of filter 122. The cutoff frequency of both the highpass filter 112 and the lowpass filter 122 is a function of the compromise desired between the privacy required against a relatively rare speech sound and the ease of detecting emergency sounds.

To provide a higher degree of privacy desired, switch 130 may be switched to the closed condition connecting noise generator 132 to summation circuit 120. The frequency range of the noise wave should just cover the bandpass range of filter 134; i.e., in the present example, 300 to 3,000 Hz. The level of the noise should be sufficient to completely mask the attenuated voice components that pass through the reject regions of filters 112 and 122 but not strong enough to annoy the listener nor severely mask the sounds necessary for providing the desired security. Thus, the noise will mask the high intelligibility speech components but it will not reduce the efficiency of personnel monitoring the system.

The utilization of just the highpass filter 112 and the lowpass filter 122 may provide sufficient privacy for many applications of this invention so that it is unnecessary to provide additional processing. However, for additional privacy or more sophisticated signal distortion additional circuitry may be applied.

For example, the output of highpass filter 112 may be frequency translated by balance mixer 114. The frequency translation is produced by heterodyning or mixing the output of highpass filter 112 with the output of voltage controlled oscillator 116 appearing on line 115. The voltage controlled oscillator 116 operates at a frequency between, say, 4,300 and 7,000 Hz for the example shown in FIG. 1. Both the lower and upper range may be extended if desired but in order to convert the range of 4,000 to 10,000 Hz with difference mixing products the oscillator range of 4,300 to 7,000 Hz suffices.

Thus, this range of frequencies would translate the high frequency sounds ranging from 4 to 10 kHz required for monitoring to a range of 300 to 3,000 Hz which is suitable for transmission over narrow band telephone or radio facilities. Thus, besides further obfuscating the speech sounds the frequency translation procedure translates the filtered sounds to a more desirable frequency range.

In order to enhance the privacy of the system, VCO 116 is caused to randomly alter its frequency as a function of the voltage produced by Random Function generator 118 which may take the form of a noise generator and it is desirable to have it change its output at a rate of at least approximately 10 Hz; i.e., at the syllabic rate of speech. The output voltage level should be sufficient to cause the VCO to change its frequency over the full range of 4,300 Hz to 7,000 Hz which will convert some sound components in the frequency of 4 kHz to 10 kHz to a range of 300 to 3,000 Hz. If higher frequency sounds are to be monitored, the upper 7,000 Hz limit should be increased.

The output of Balanced Mixer 114 feeds summation circuit 120 which feeds BPF 134 which selects mixing products produced in Balanced Mixer 114 falling in the 300 to 3,000 Hz region.

In a similar fashion, audio components below 300 Hz are selected by lowpass filter 122 and translated in frequency to the range of 300 Hz to 3,000 Hz. The actual frequency of these originally low frequency components is a random function as determined by VCO 126 operating, for example, at a frequency of approximately 600 to 3,300 Hz appearing on line 125 which in turn is controlled by random function generator 128. It is possible to use one random function generator instead of two (118 and 128) but with some loss of privacy. If a single random function generator is used, it can directly feed VCO 116 and VCO 126 or one of the VCO's can incorporate a time delay network in its control lead so as to avoid synchronism of the control functions.

The output of Balanced Mixer 124 includes a sum and difference component which is fed to summation circuit 120 which feeds bandpass filter, BPF 134. At certain instants the sum mixing component falls within the passband of BPF 134 and is selected, and at other instants the difference component is selected. Furthermore, at many instants the sum and difference components will both be selected.

The highly distorted audio wave at the outpuf of BPF 134 feeds amplifier 136 which amplifies the scrambled wave to a suitable level and impedance so that it may feed a telephone line 138 or radio transmitter or other circuits for transmission to central office monitoring equipment 140.

The central office monitoring equipment may incorporate amplifiers, scanning circuits, loudspeakers, recording equipment, sound controlled alarms, oscilloscopes, spectrum analyzers, and other circuitry and equipment required or desired for efficient and reliable monitoring of the protected area. Such circuitry is well known to those skilled in the art and may be readily integrated into the present system and method.

It is possible to substitute a noise generator for the Random Function Generator 118, and VCO 116 as well as Random Function Generator 108 and VCO 126. In this case it is necessary that noise generator must have sufficient energy content covering the range of 4,300 to 7,000 Hz to substitute for blocks 116 and 118. The noise generator substituting for blocks 126 and 128 should have sufficient energy content in the 600 to 3300 Hz region. It will be recognized that one noise generator may, in order to minimize cost, be used to feed energy to lines 115 and 125 as well as performing the function of block 132. It will be understood by those skilled in the field that a conventional noise generator will produce a wave having both angular modulation and amplitude modulation components. On the other hand, VCO 116 and VCO 126 are constant in amplitude and therefore the output of the VCO is free of amplitude modulation. However, either type wave is suitable for this application and in may cases the noise generator is less expensive than the arrangement shown in FIG. 1.

Figure 2:
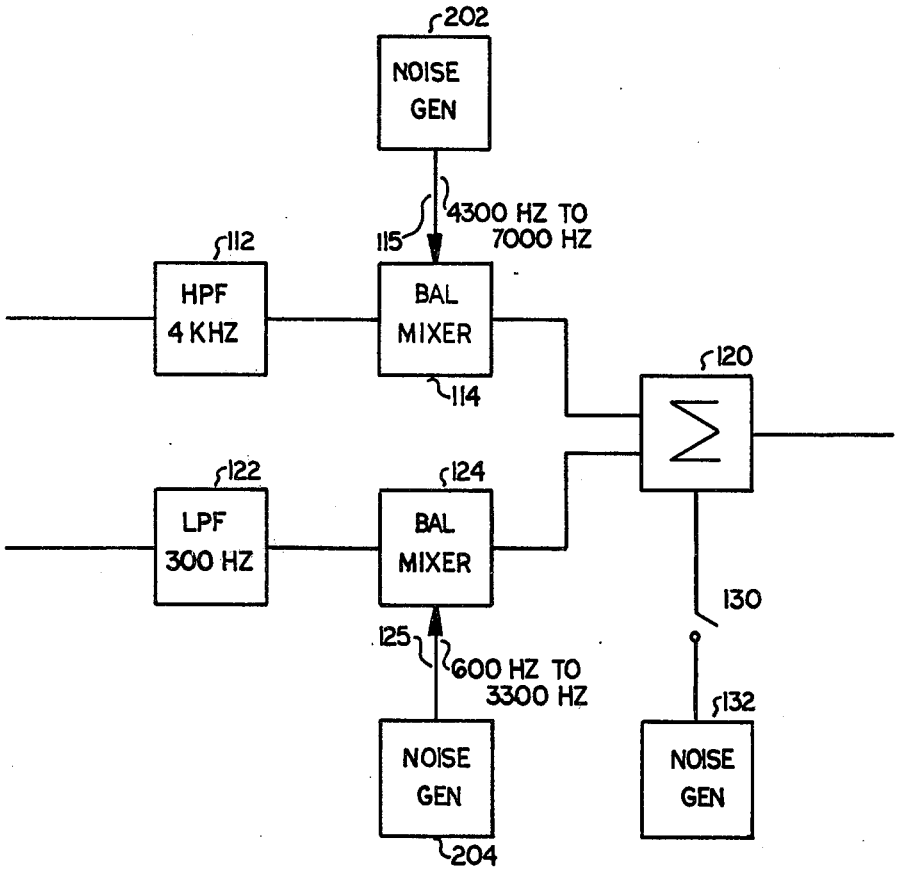
FIG. 2 is a block Diagram, showing a modification of the embodiment shown in FIG. 1.

FIG. 2 illustrates in block diagram form the use of Noise Generators rather than the combination voltage controlled oscillator VCO and Random Function Generator arrangement shown in FIG. 1.

Noise Gen. 202 is connected to line 115 which in turn feeds Bal. Mixer 114. It is necessary that at least a substantial amount of energy covering the 4,300 to 7,000 Hz band of frequency be available from noise generator 202. If the energy content is not suitable for this application, a bandpass filter covering the range of 4,300 to 7,000 Hz range may be provided with a suitable amplifier. Line 115 then feeds Balanced Mixer 114 and the desired mixing products are provided by the Balanced Mixer.

In a similar fashion, Noise Generator 204 may be substituted for VCO 126 and Random Function Generator 128 of FIG. 1. In this case it is required that components fall in the 600 Hz to 3,300 Hz region as shown in this example. In this case, if energy content is not proper, a filter and amplifier favoring the desired components may be provided.

It should be noted that three noise generators are shown in FIG. 2. It would be desirable for some applications of the invention to combine the function of two or three generators into one, thus decreasing the equipment cost.

VCO 116 and 126 may be constructed according to conventional design techniques as described in standard electronic design texts. Balanced Mixers 114 and 124 may, for example, utilize an integrated circuit MC1596 as manufactured by Motorola, Phoenix, Ariz.

Random Function generators 118 and 128 take the form of a noise generator utilizing the same design techniques as used in the GR-1390A noise generator manufactured by Gen. Rad., Concord, Mass. It is also possible to use such design techniques for Noise Generator 132. In some applications of this invention, filtering favoring desired noise components may be desirable and would be applied by the designer of equipment utilizing this invention.

As pointed out above, one noise generator can be used to serve the three functions requiring random function generators and noise generator shown in the FIG. 1 embodiment of this invention.

The circuitry required to destructively encode the signal can utilize a number of different procedures as will be apparent to one skilled in the art. Included in such procedures are methods for encoding speech in use in privacy and secrecy systems. For example, systems have been developed whereby the frequency components of the speech are translated in frequency by a sufficient amount to destroy intelligibility. Also, methods have been developed for introducing an interferring echo which provides a degree of privacy . U.S. Pat. No. 2,880,275 describes one such system. In addition, double sideband suppressed carrier systems may be used for privacy; for example, the system described in U.S. Pat. No. 2,784,311.

Also, there have been a number of inventions which utilize frequency translation so as to make it possible to utilize two or more narrow channels in a wideband system.

In all such systems, the end result desired is good intelligibility and/or good quality. In the instant invention, similar procedures of frequency translation, etc. may be used but in an altogether different fashion so that the end result is not improvement in intelligibility or quality but resistance to decoding.

The filtering and frequency translating procedures may follow the teachings of U.S. Pat. No. 3,696,298 (Kahn and Gordon) wherein high and low frequencies are selected by sharp filters and then their frequencies are translated so that a conventional 300 to 3 kHz voice grade line may be used for their transmission. Similar circuitry may be used in the instant invention although here it is not necessary that the translation be accomplished so that it can be readily decoded. Therefore, the high and low frequency components may be made to overlap. Of course, the midband signal which is transmitted through line 1, in the invention, disclosed in U.S. Pat. No. 3,696,298 would not be transmitted.

Also, a less expensive version of the system may be made by merely processing high frequency components above 3 or 4 kHz. The loss in non-speech information content, by eliminating all components below 3,000 or 4,000 Hz, is not particularly poorer for most sounds than just eliminating the mid-range frequencies from 300 to 3,000 Hz. Speech tempo and sharp impulse noise and the amplitude of the speech sounds may generally be perceived by merely monitoring the frequencies above 3 or 4 kHz. Therefore, for many applications, the circuitry shown in blocks 122, 124, 126 and 128, as well as summation circuit 120, may be deleted.

The narrower the speech frequency range transmitted, the greater the degree of privacy. However, narrower transmitted frequency ranges reduce the clues provided to determine emergency conditions. Therefore, destructive encoding is a compromise between the privacy of the system and the readability of the danger indicating signals.

The invention may also be applied to personal security systems whereby the individual is protected when walking in streets, parks, etc. In this case, a radio system is required and the system would utilize a light weight microphone which could be used for picking up ambient sounds including speech waves. The output of the microphone would then be destructively encoded so that the user's privacy would be ensured. The output of the encoding unit would then feed a portable radio transmitter.

It is desirable, in order to minimize the size and weight of the transmitter, to have a large number of receivers located near paths where the individual might traverse. This would minimize the required range of the transmitter and its power requirement. These receivers would then feed lines going back to a monitoring point allowing individuals to listen for any distress sounds. The portable unit may be equipped with a switching arrangement so that, at the option of the user, the destructive encoding can be temporarily disabled allowing clear speech to be transmitted. One who is passing a dangerous area, or had reason to be afraid of the situation, could then switch to a clear transmission in order to allow the monitoring employee to more readily determine if assistance is required.

It should be apparent to those skilled in the art that there are numerous methods for destroying the intelligibility of a voice signal which may be utilized in implementing the instant invention. The important characteristics of such methods are that they are secure against decoding while passing sufficient information for a listener to identify security problems and other emergencies. Of course, cost, size and other practical aspects must be considered.

The feature of the present invention that greatly simplifies the problem of encoding and destroying intelligence is that it is entirely unnecessary to consider decoding problems.

From the foregoing, further variations, modifications, and applications of the invention will be apparent to those skilled in the art to which the invention is addressed, within the scope of the following claims.

What is claimed is:

1. The method of providing security for individuals without violating the privacy of their conversations, comprising:
   (a) converting sound waves, including voice waves present at a location to be protected, to electrical waves,
   (b) processing said electrical waves so as to substantially reduce the information borne by normal conversation speech waves while not substantially degrading the intelligibility borne by certain other waves outside the intelligible speech band which carry signals indicating emergency conditions, said waves being available for detection by monitoring personnel, and
   (c) transmitting the waves processed by step (b) to a remote location.

2. The method of claim 1, including the step of temporarily disabling the (b) altering step from the procedure whenever the user does not desire privacy.

3. The method of claim 1 wherein the other waves indicating emergency conditions of Step (b) include at least part of speech sounds uttered during dangerous conditions.

4. A system for providing security for individuals without substantially interfering with said individual's privacy of conversation, comprising:
   (a) a microphone located so as to pick up sounds in an area to be made secure,
   (b) means for permanently destroying substantially all speech intelligence picked up by the microphone so as to insure privacy of conversation, while not eliminating at least some sound information in the resulting audio signal indicative of the security conditions of the protected individuals, and
   (c) means for transmitting the audio signal to a remote monitoring location.

5. A security system comprising;
   (a) a transducer for converting sound waves to an electrical wave,
   (b) means for substantially reducing the information borne by normal conversation speech waves contained in the electrical wave while allowing other information contained in at least some of the non-speech sound waves which can indicate emergency conditions to be passed,
   (c) means for transmitting the output of (b) means to a remote monitoring location, and
   (d) means for disabling the (b) means whenever the user does not desire privacy.

6. The system, as claimed in claim 5, with switching means for allowing the (b) means to be switched out of the system when it is desirable to transmit speech signals to the monitoring location.

7. The system of claim 5, wherein the (b) means comprises filters that greatly attenuate voice components, in the range of approximately 300 Hz to approximately 3,000 Hz.

8. The system of claim 7, wherein the (b) means includes noise generating means for combining noise components with the signal.

9. The system of claim 5, wherein the (b) means comprises frequency translation means for translating at least a substantial portion of the speech components.

10. The system of claim 9, wherein the amount and rate of frequency translation is a random function.

11. The system of claim 5, wherein the means for transmitting the processed electrical wave to a remote location comprises wired channels.

12. The system of claim 10, wherein the means for transmitting the processed electrical wave to a remote location is by radio circuits.

13. A personal safety system comprising:
   (a) a light weight microphone,
   (b) means for substantially reducing the information borne by normal conversation speech waves in the intelligible spech band picked up by said microphone while not substantially degrading the intelligibility borne by certain other waves outside the intelligible speech band which carry signals indicating emergency conditions, said other waves being available for detection by monitoring personnel, and,
   (c) a portable radio transmitter incorporating modulation means connected to means (b).

14. The system, according to claim 13, wherein switching circuitry is provided for disabling the speech destruction means (b).

15. A security system which provides protection without violating speech privacy comprising:
   (a) one or more microphones and associated amplifiers,
   (b) a highpass filter having a cutoff frequency in the order of 4 kHz and sufficient selectivity to substantially destroy speech intelligibility fed by (a) amplifiers output,
   (c) frequency translation means for translating at least some of the frequency components at the output of the highpass filter to the range of 300 to 3,000 Hz,
   (d) means for transmitting the output of the frequency translation means to a remote site, and
   (e) means at the remote site for processing and monitoring the received filtered and frequency translated signal.

16. The security system of claim 15, wherein noise output from a noise generating means is added to the signal prior to transmission to the remote site.

17. A security system which provides protection without violating speech privacy comprising:
   (a) one or more microphones and associated amplifiers,
   (b) a lowpass filter having a cutoff frequency in the order of 300 Hz and sufficient selectivity to substantially destroy speech intelligibility fed by (a) amplifiers output, (c) frequency translation means for translating at least some of the frequency components at the output of the lowpass filter to the range of 300 to 3,000 Hz, (d) means for transmitting the output of the frequency translation means to a remote site, and (e) means at the remote site for processing and monitoring the filtered and frequency translated signal at said remote site.

18. The security system of claim 17 wherein noise output from a noise generating means is added to the signal prior to transmission to the remote site.

19. A security system for providing protection of individuals without violating speech privacy comprising;

(a) one or more microphones and associated amplifiers, (b) a highpass filter having a cutoff frequency in the order of 4 kHz and having sufficient selectivity to substantially destroy speech intelligibility fed by (a) amplifiers output, (c) frequency translation means for translating at least some of the frequency components at the output of the highpass filter to the range of 300 to 3,000 Hz, (d) a lowpass filter having a cutoff frequency in the order of 300 Hz and having sufficient selectivity to substantially destroy speech intelligibility fed by (a) amplifiers output, (e) frequency translation means for translating at least some of the frequency components at the output of the lowpass filter to the range of 300 to 3,000 Hz, (f) means for transmitting the output of the frequency translation means of (c) and (e) to a remote site, and (g) means at the remote site for processing and monitoring the filtered and frequency translated signal at said remote site.

20. The security system of claim 19, wherein noise output from a noise generating means is added to the signals prior to transmission to the remote site.

* * * * *